United States Patent [19]

Sekiya

[11] Patent Number: 4,811,842

[45] Date of Patent: Mar. 14, 1989

[54] CASE FOR STORING SPARE LEADS

[75] Inventor: Takashi Sekiya, Soka, Japan

[73] Assignee: Chitose Kagaku Kogyo Co., Ltd., Saitama, Japan

[21] Appl. No.: 94,900

[22] Filed: Sep. 10, 1987

[30] Foreign Application Priority Data

Aug. 3, 1987 [JP] Japan ..... 62-119005[U]

[51] Int. Cl.[4] ..... B65H 3/22

[52] U.S. Cl. ..... 206/443; 221/248; 221/312 R

[58] Field of Search ..... 220/346; 206/443; 221/312 R, 247, 248

[56] References Cited

U.S. PATENT DOCUMENTS 2,960,259 11/1960 Aveni ..... 221/312 R
3,212,670 10/1965 Tint et al. ..... 220/312 R
4,440,313 4/1984 Krassnig ..... 221/248

FOREIGN PATENT DOCUMENTS 1408868 7/1965 France ..... 220/346

*Primary Examiner*—Joseph M. Moy
*Attorney, Agent, or Firm*—Holman & Stern

[57] ABSTRACT

The present invention provides a storage case which has a case body that does not have to be inverted when spare leads are removed therefrom, and in which the spare leads are automatically made to project from a lead extraction port provided in the case body so that the spare leads can be prevented from being broken or lost by mistake, as in conventional cases.

11 Claims, 3 Drawing Sheets

CASE FOR STORING SPARE LEADS

BACKGROUND OF THE INVENTION

1. Field of the Invention

The present invention relates to a case for storing spare leads for a mechanical pencil.

Examples of conventional storage cases include a case having a cap which is detachably provided on a case body and, a case having a cap which is slidably fitted into a case body. In the former case, it is necessary to remove the cap from the case body when replacing or removing spare leads; in the latter case, the cap need not to be removed, but the case body must be inverted in the same manner as with the former case.

Therefore, when the case body is inverted, the spare leads contained in the case body are sometimes allowed to fall out and are thus broken or lost.

SUMMARY OF THE INVENTION

The present invention has been achieved with a view to providing a storage case which has a case body that does not have to be inverted when spare leads are removed therefrom, and in which the spare leads are automatically made to project from a lead extraction port provided in the case body so that the spare leads can be prevented from being broken or lost by mistake, as in conventional cases.

DESCRIPTION OF THE PREFERRED EMBODIMENTS

Figure 1:
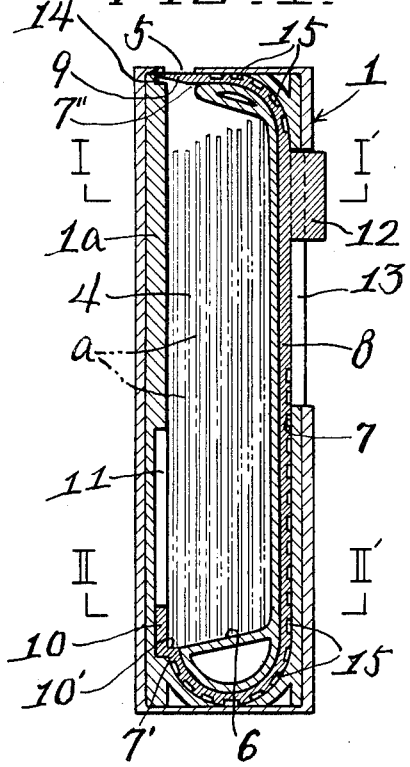
FIG. 1 is a sectional view of a first embodiment.
Figure 2:
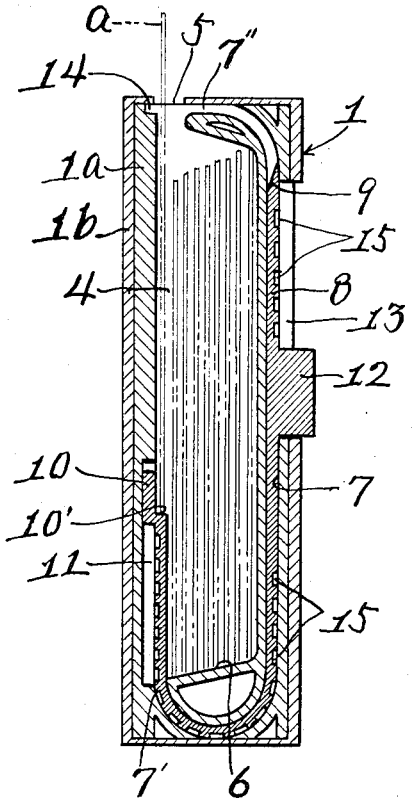
FIG. 2 is a sectional view showing a state wherein a lead extraction port is open.
Figure 3:
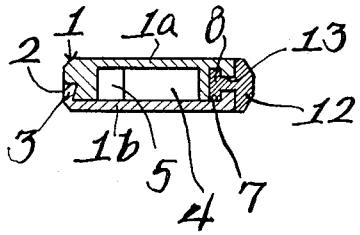
FIG. 3 is a sectional view taken along the line I–I′ of FIG. 1.
Figure 4:
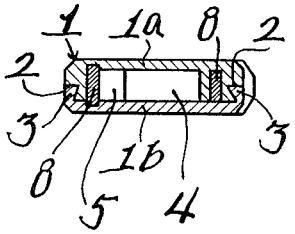
FIG. 4 is a sectional view taken along the line II–II′ of FIG. 1.

Cases for storing spare leads to which the present invention relates are described in detail below with reference to the embodiments shown in the drawings.

In each embodiment, reference numeral 1 denotes a case body which is made of a synthetic resin and which is formed by press-fitting a projection piece 3 provided along the length of a side edge of an opaque second member 1*b* into a dovetail groove 2 provided along the length of a side edge of a transparent first member 1*a*. Reference numeral 4 denotes a chamber for receiving spare leads which is provided in the case body and which has a rectangular sectional form, reference numeral 5 denotes a lead extraction port provided on one side of an upper end of the receiving chamber 4, and reference numeral 6 denotes a bottom wall of the receiving chamber 4. The bottom wall 6 is inclined gradually downword from one end thereof to the other end immediately under the lead extraction port 5 so as to make spare leads a received in the receiving chamber 4 automatically move toward a position immediately under the lead extraction port 5.

Reference numeral 7 denotes a guide space which is provided aligned with the outside of the receiving chamber 4 and in which a lower-end opening 7′ is provided in the bottom wall and an upper-end opening 7″ is provided at the edge of the lead extraction port 5. A driving piece 8 made of a flexible synthetic resin material is received in the guide space 7 in such a manner that it can move longitudinally, and a lid member 9 which moves in and out of the upper-end opening 7″ of the guide space 7 is integrally provided at the upper end of the driving piece 8.

(First embodiment)

FIGS. 1 to 4 show a first embodiment. In the structure of this embodiment, the lower portion of the guide space 7 is placed right under the bottom wall 6 of the receiving chamber 4 so that the lower-end opening 7′ is arranged at the lower end of the bottom wall 6 and the lower end of the driving piece 8 projects from the lower end opening 7′ to form a holding piece 10 whose inner surface is provided with an edge 10′ for holding the spare leads, the holding piece 10 being slidably fitted into a guide groove 11 provided in the lower portion of the side wall of the receiving chamber 4 in such a manner that it can move longitudinally. An operational member 12 provided on an intermediate portion of the driving piece 8 is led out to the outside through a longitudinally extended guide window 13 which is provided in the case body 1, in communication with an intermediate portion of the guide space 7.

FIG. 1 shows a state wherein the spare leads a are stored, and the lead extraction port 5 is closed by the lid member 9 whose end engages with a notch 14 provided in one edge of the lead extraction port 5 and the holding edge 10′ of the holding piece 10 projecting from the lower-end opening 7′ of the guide space 7 is placed on the extension of the lower end of the inclined bottom wall 6 of the receiving chamber 4, so that the lower end of a spare lead guided along the slope of the bottom wall 6 is loaded onto the holding edge 10′.

When the operational member 12 is lowered along the guide window 13 from the above-described state, the driving piece 8 integrally provided with the operational member 12 is lowered through the guide space 7 in communication therewith so that the lead extraction port 5 is opened by the lid member 9 received in the guide space 7 through the upper-end opening 7″, and the holding piece 10 provided at the lower end of the driving piece 8 is raised along the guide groove 11 so that the spare lead a loaded on the holding edge 10′ is pushed upward. The upper end of the spare lead a is made to project from the open lead extraction port 5 of the receiving chamber 4 so that the spare lead a can be removed (FIG. 2), and, when the operational member 12 is raised along the guide window 13, various portions are returned to their original states shown in FIG. 1.

In the drawings, reference numeral 15 denotes notches which are provided in the driving piece 8 to enable the driving piece 8 to move smoothly.

(Second embodiment)

Figures 5, 6, 7:
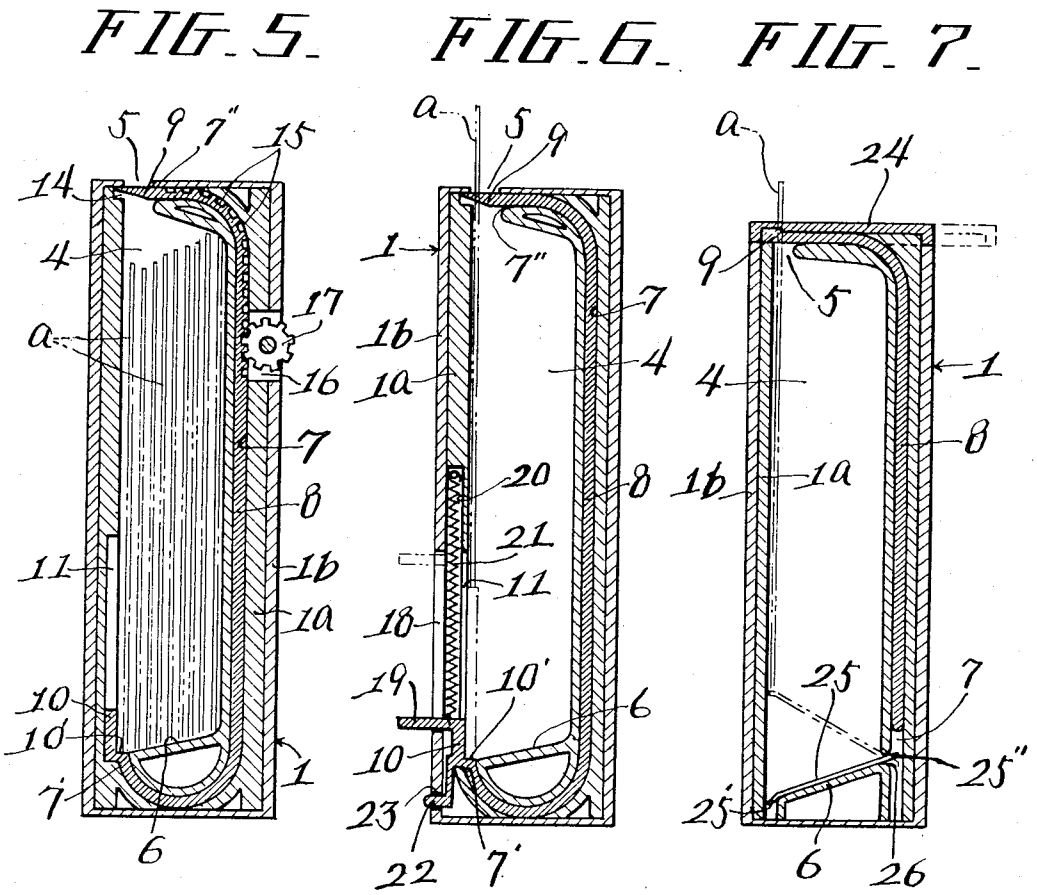
FIG. 5 is a sectional view of a second embodiment.
FIG. 6 is a sectional view of a third embodiment.
FIG. 7 is a sectional view of a fourth embodiment.

FIG. 5 shows a second embodiment. In this second embodiment, a window 16 communicating with the guide space 7 is provided in the case body 1, and an operational gear 17 is rotatably provided in the window 16, the various portions being worked by the operation of the operational gear 17 in engagement with the driving piece 8.

(Third embodiment)

FIG. 6 shows a third embodiment. In FIG. 6, reference numeral 18 denotes a guide window communicating with the guide groove 11, an operational member 19 horizontally provided on the holding piece 10 which is integrally provided on the driving piece 8 being passed through the guide window 18 so as to project to the outside. An engagement hole 20 which is open at its lower end is formed at a position adjacent to the upper end of the guide groove 11, and the lower end of a spring 21 whose upper end is fixed to the upper end of the engagement hole 20 being fixed to the operational member 19. In the third embodiment, when the operational member 19 is raised along the guide window 18 against the force of the spring 21, the lead extraction port 5 is opened and a lead a projects from the lead extraction port 5.

In the drawing, reference numeral 22 denotes a control member which is provided on the driving piece 8 in connection therewith. After the lead extraction port 5 has been opened by disengaging the control member 22 from a through hole 23 provided under the guide window 18 and by operating the operational member 19 in the manner described above, when the operational member 19 is released by the fingers, the operational member 19 is forced down by the spring 21 and the control member 22 is again engaged with the through hole 23 by an elastic reaction so that the lead extraction port 5 is kept in closed by the lid member 9.

(Fourth embodiment)

FIG. 7 shows a fourth embodiment in which an operational frame 24 is slidably fitted into the upper end of the case body 1, the lid member 9 is engaged with the operational frame 24 so that they are connected to each other, a holding piece 25 provided with a holding edge 25′ is mounted on the bottom wall of the receiving chamber 4, and a base end 25″ of the holding piece 25 is passed through a communicating hole between the receiving chamber 4 and the guide space 7 so as to project in the guide space 7, the lower end of the driving piece 8 being placed right above the base end 25″. When the operational frame 24 is moved horizontally, the lead extraction port is opened and the lower end of the driving piece 8 pushes the base end 25″ of the holding piece 25 downward so that the holding edge 25′ on the end of the holding piece 25 makes a spare lead a project from the receiving chamber 4 through the lead extraction port 5 by the lowering of the base end 25″, as shown by broken lines in the drawing.

(Fifth embodiment)

Figure 8:
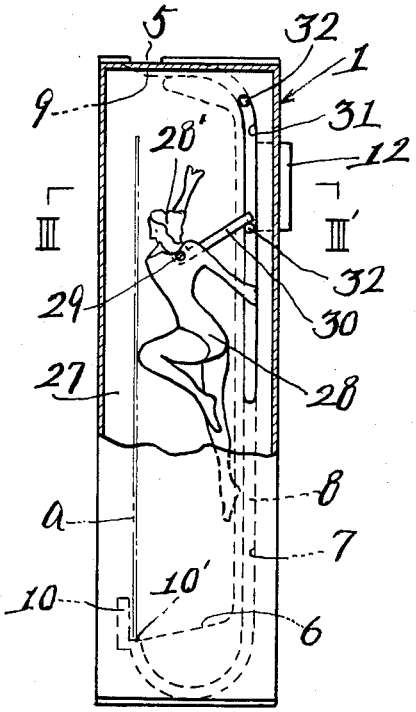
FIGS. 8 to 10 illustrate a fifth embodiment, FIG. 8 being a front view, FIG. 9 being a front view showing the state wherein a lead extraction port is open, and FIG. 10 being a sectional view taken along the line III–III′ of FIG. 8.
Figure 9:
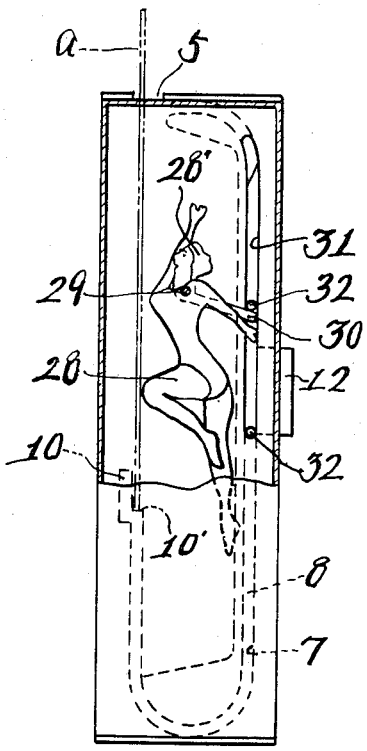
Figure 10:
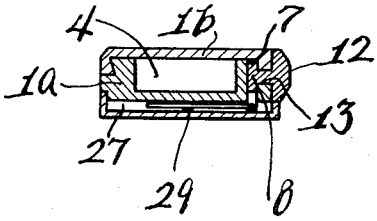

FIGS. 8 to 10 show a fifth embodiment in which a space 27 which can be seen through the case body from the outside is provided in front of the receiving chamber 4, a doll 28 is received in the space 27, the head 28′ of the doll is rotatably pivoted on a support shaft 29, the end of an arm piece 30 provided on the head 28′ is placed in a hole 31 communicating with the guide space 7, and two tappets 32 horizontally provided on the driving piece 8 are made to project in the space 27 through the communicating hole 31 so that the head 28′ is caused to move around the support shaft 29 by the tappets 32 which are brought into contact with and separated from the arm piece 30.

In other words, the fifth embodiment is adapted to satisfy an interest in design, but, in order to satisfy that interest, the present inveniton is not limited to the doll 28 of this embodiment and any suitable article may be received in the space 27 and interlocked with the operation of the driving piece 8.

In the present invention configured as described above, the lead extraction port is opened by operating the driving piece and, at the same time, a spare lead is made to project from the extraction port and, thus, can be easily removed.

I claim:

1. A case for storing spare lead comprising a chamber for receiving spare leads which is provided in a case body; a lead extraction port which is provided at the upper end of said receiving chamber; a driving piece which has a lid member for said lead extraction port at its upper end and is longitudinally movably received in said case body in such a manner that it can be operated from the outside; and a holding piece for said spare leads which is associates with the lower end of said driving piece in such a manner that it can lift a lead which is located at one side of the chamber under said lead extraction port up through the port when the driving piece is operated to remove the lid from the port wherein the bottom wall of said receiving chamber is inclined downwardly toward said one side so that stored leads are moved successively toward said holding piece as leads are removed from the case.

2. A case for storing spare leads according to claim 1, wherein said driving piece is made of a flexible synthetic resin material.

3. A case for storing spare leads according to claim 1, wherein said driving piece is engaged with a guide space and a longitudinally extended guide window communicating with said guide space is provided in said case body, and an operational member is provided on an intermediate position of said driving piece such as to be let out to the outside of said case body through said guide window.

4. A case for storing spare leads according to claim 1, wherein a window communicating with said guide space for said driving piece is provided in said case body and an operational gear is rotatably provided in said window, said operational gear being engaged with said driving piece.

5. A case for storing spare leads according to claim 1, wherein an operational member is horizontally provided on said piece for holding said spare leads and is led out to the outside of said case body through a guide window communicating with a guide groove for said holding piece.

6. A case for storing spare leads according to claim 5, wherein a spring is interposed between said operational member and the upper end of said guide groove for said holding piece.

7. A case for storing spare leads according to claim 1, wherein an operational frame is slidably fitted in the upper end of said case body and said lid member for said lead extraction port provided at the upper end of said driving piece is integrally engaged with said operational frame.

8. A case for storing spare leads according to claim 1, wherein said holding piece provided with said edge for holding said spare leads at its end is mounted on said bottom wall of said receiving chamber and a base end of said holding piece is made to project in said guide space through a communicating hole between said receiving chamber and said guide space for said driving piece, the lower end of said driving piece being placed just above said base end of said holding piece.

9. A case for storing spare leads according to claim 8, wherein said bottom wall of said receiving chamber is inclined and said edge for holding a spare lead provided on said holding piece is disposed on the lower end of said bottom wall.

10. A case for storing spare leads according to claim 1, wherein a space which can be seen through said case body from the outside is provided on the front of said receiving chamber for said spare leads and an article such as a doll is received in said space, said article being interlocked with said driving piece.

11. A case for storing spare leads according to claim 10, wherein the head of said doll is rotatably pivoted on a support shaft in said space, and the end of an arm piece provided on said head is placed in a communicating hole between said space and said guide space for said driving piece, two tappets horizontally provided on said driving piece being passed through said communicating hole and made to project into said space via the end of said arm piece.

* * * * *